US010228196B2

(12) United States Patent
Grantham et al.

(10) Patent No.: US 10,228,196 B2
(45) Date of Patent: Mar. 12, 2019

(54) METHOD AND APPARATUS FOR MODULAR AIR-TO-AIR HEAT EXCHANGER

(71) Applicant: SCHNEIDER ELECTRIC IT CORPORATION, West Kingston, RI (US)

(72) Inventors: Roy L. Grantham, O'Fallon, MO (US); Paul Timothy Dierkes, Eureka, MO (US); Joseph Michael Kuelker, San Diego, CA (US)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 0 days.

(21) Appl. No.: 15/423,707

(22) Filed: Feb. 3, 2017

(65) Prior Publication Data

US 2018/0224217 A1 Aug. 9, 2018

(51) Int. Cl.
*F28F 7/00* (2006.01)
*F28F 9/00* (2006.01)
(Continued)

(52) U.S. Cl.
CPC ..... *F28F 3/083* (2013.01); *F28D 1/053* (2013.01); *F28D 5/02* (2013.01); *F28F 9/001* (2013.01);
(Continued)

(58) Field of Classification Search
CPC .... F28D 1/0426; F28D 1/0435; F28D 1/0443; F28D 9/002; F28D 2009/004; F28D 9/0075; F28D 9/007; F28F 9/001; F28F 9/002; F28F 2009/004; F28F 9/0075; F28F 9/007; F28F 2280/02; F28F 2280/06
USPC ..... 165/67, 76, 149
See application file for complete search history.

(56) References Cited

U.S. PATENT DOCUMENTS 2,656,157 A 10/1953 Wasielewski
3,986,549 A * 10/1976 Huggins ..... F28F 3/00 165/145
(Continued)

FOREIGN PATENT DOCUMENTS

WO 2005008162 A1 1/2005
WO 2014155308 A1 10/2014
WO 2015156082 A1 10/2015

OTHER PUBLICATIONS

Extended European Search Report from corresponding European Application No. 18154733.2 dated Jun. 11, 2018.

*Primary Examiner* — Jason Thompson
(74) *Attorney, Agent, or Firm* — Lando & Anastasi, LLP

(57) ABSTRACT

A heat exchanger core assembly includes a frame assembly and a plurality of core bundles positioned within the frame assembly. Each core bundle includes at least one row of tubing defining at least one end of the core bundle, an edge seal gasket to seal the core bundle from an adjacently placed core bundle, and an indoor face seal gasket to seal the end with respect to the frame assembly. A method of replacing a core bundle of a heat exchanger core assembly includes identifying a core bundle requiring replacement, removing the core bundle by accessing the core bundle and sliding the core bundle with respect to the remaining plurality of core bundles from the frame assembly, and inserting a replacement core bundle in a space defined by the removed core bundle.

9 Claims, 13 Drawing Sheets

(51) Int. Cl.

| | |
|---|---|
| ***F28D 1/00*** | (2006.01) |
| ***F28F 3/08*** | (2006.01) |
| ***F28D 1/053*** | (2006.01) |
| ***F28D 5/02*** | (2006.01) |
| ***F28F 9/013*** | (2006.01) |

(52) U.S. Cl.
CPC ..... *F28F 9/013* (2013.01); *F28F 2009/004* (2013.01); *F28F 2230/00* (2013.01)

(56) References Cited

U.S. PATENT DOCUMENTS

| | | | | |
|---|---|---|---|---|
| 4,253,516 | A * | 3/1981 | Giardina | F22B 1/16 165/162 |
| 4,377,025 | A * | 3/1983 | Masai | B23P 15/26 248/324 |
| 4,681,157 | A * | 7/1987 | Schwarz | F28F 7/02 165/145 |
| 5,131,459 | A * | 7/1992 | Thompson | F22B 37/202 122/510 |
| 2012/0205068 | A1* | 8/2012 | Martindale | F28D 7/1615 165/67 |
| 2012/0255709 | A1* | 10/2012 | Kinder | F28F 9/002 165/67 |
| 2013/0213625 | A1* | 8/2013 | Sægrov | F28D 9/0025 165/175 |
| 2013/0284399 | A1* | 10/2013 | Yang | F28F 9/00 165/67 |
| 2017/0167797 | A1 | 6/2017 | Tomioka et al. | |

* cited by examiner

METHOD AND APPARATUS FOR MODULAR AIR-TO-AIR HEAT EXCHANGER

BACKGROUND OF THE DISCLOSURE

1. Field of the Disclosure

The present disclosure relates to cooling systems, and more particularly to a modular air-to-air heat exchanger.

2. Discussion of Related Art

One approach to cooling large spaces, such as data centers, is to utilize extremely large air-to-air heat exchanger units (AHUs) mounted to one or more external building faces or to the roof. Modern AHUs contain extremely large heat exchangers, such as ten feet long, seven feet wide and seven feet high, containing almost 2,000 heat exchanger tubes. Assembly of such a large heat exchanger without modularity is not easy, costly to manufacture and difficult to service. The current AHU heat exchangers require removal of the entire heat exchanger from the unit in order to service or replace. The current EcoBreeze® unit is smaller and semi-modular in that the heat exchanger is divided into bundles, but to service or replace the lower or bottom bundles, all of the bundles need to be removed.

SUMMARY OF THE DISCLOSURE

One aspect of the present disclosure is directed to a heat exchanger core assembly comprising a frame assembly and a plurality of core bundles positioned within the frame assembly. Each core bundle includes at least one row of tubing defining at least one end of the core bundle, an edge seal gasket to seal the core bundle from an adjacently placed core bundle as well as sealing against outer core side walls, and an indoor face seal gasket to seal the end with respect to the frame assembly.

Embodiments of the heat exchanger core assembly further may include configuring the frame assembly to have a base frame section and a support frame section extending from the base frame section. The support frame assembly of the frame assembly may include a plurality of vertical posts and horizontal rails that are configured to support the plurality of core bundles, the horizontal rails being configured to define at least one shelf. The plurality of core bundles may be positioned within the support frame section in a manner in which each core bundle extends end-to-end with respect to an orientation of the base frame section. The plurality of core bundles may include ten core bundles. Each core bundle may include four rows of tubing, with 48 tubes per row. Each core bundle may be approximately ten feet long. Each row of tubing may be secured by a tube support. The one row of tubing may define a first end and a second end, each of the first end and the second end having the edge seal gasket and the indoor face seal gasket. The face seal gasket may seal the core bundle in a manner that prevents the leakage of indoor air into the outdoor air space, and the outdoor edge seal gasket may seal the core bundle in a manner that prevents intrusion of outdoor air into the indoor air space. The rows of core bundles may be offset from one another. The heat exchanger core assembly further may include a side wall configured to enclose a side or a portion of a side of the heat exchanger core assembly. The side wall may include a frame, an upper flange provided along a top edge of the rectangular frame, a lower flange provided along a bottom edge of the rectangular frame, and at least one inner panel supported by the frame. The one inner panel may include a horizontally disposed raised panel section and a horizontally disposed recessed panel section to offset sides of adjacent core bundles. The side wall further may include a gasket provided around an edge of the frame. The heat exchanger core assembly further may include a center wall configured to be positioned lengthwise between two adjacently placed core bundles. The center wall may include at least one inner panel supported and at least one hanging bracket provided along a length of the one inner panel. The hanging bracket may be configured to hang on a core of a core bundle to support the center wall. The one inner panel may include a horizontally disposed raised panel section and a horizontally disposed recessed panel section to offset sides of adjacent core bundles.

Another aspect of the present disclosure is directed to a method of replacing a core bundle of a heat exchanger core assembly. In one embodiment, the heat exchanger core assembly includes a frame assembly and a plurality of core bundles positioned within the frame assembly. The plurality of core bundles are positioned within the frame assembly in a manner in which each core bundle extends end-to-end with respect to an orientation of the base frame section, with each core bundle including at least one row of tubing. The method comprises identifying a core bundle requiring replacement, removing the core bundle by accessing the core bundle and sliding the core bundle with respect to the remaining plurality of core bundles from the frame assembly, and inserting a replacement core bundle in a space defined by the removed core bundle.

Embodiments of the method further may include sealing an end of the replacement core bundle from an adjacently placed core bundle with an edge seal gasket, and/or sealing the end of the replacement core bundle with respect to the frame assembly by an indoor face seal gasket. The method further may include securing each row of tubing is secured by at least two tube supports spaced apart from one another along a length of the row of tubing. The one row of tubing may define a first end and a second end, with each of the first end and the second end having the edge seal gasket and the indoor face seal gasket. The edge seal gasket may seal the core bundle in an outside air exhaust direction and the indoor face seal gasket may seal the core bundle in an indoor air direction. The rows of core bundles may be offset from one another. The method further may include providing a side wall configured to enclose a side or a portion of a side of the heat exchanger core assembly. The side wall may include a frame, an upper flange provided along a top edge of the rectangular frame, a lower flange provided along a bottom edge of the rectangular frame, and at least one inner panel supported by the frame. The one inner panel may include a horizontally disposed raised panel section and a horizontally disposed recessed panel section to offset sides of adjacent core bundles. The method further may include sealing the side wall and the frame assembly with a gasket provided around an edge of the frame. The method further may include providing a center wall configured to be positioned lengthwise between two adjacently placed core bundles. The center wall may include at least one inner panel and at least one hanging bracket provided along a length of the one inner panel. The hanging bracket may be configured to hang on a core of a core bundle to support the center wall. The one inner panel may include a horizontally disposed raised panel section and a horizontally disposed recessed panel section to offset sides of adjacent core bundles.

The present disclosure will be more fully understood after a review of the following figures, detailed description and claims.

BRIEF DESCRIPTION OF THE DRAWINGS

In the drawings, each identical or nearly identical component that is illustrated in various figures is represented by a like numeral. For purposes of clarity, not every component may be labeled in every drawing. For a better understanding of the present disclosure, reference is made to the figures which are incorporated herein by reference and in which.

DETAILED DESCRIPTION OF THE PREFERRED EMBODIMENTS

Figure 1:
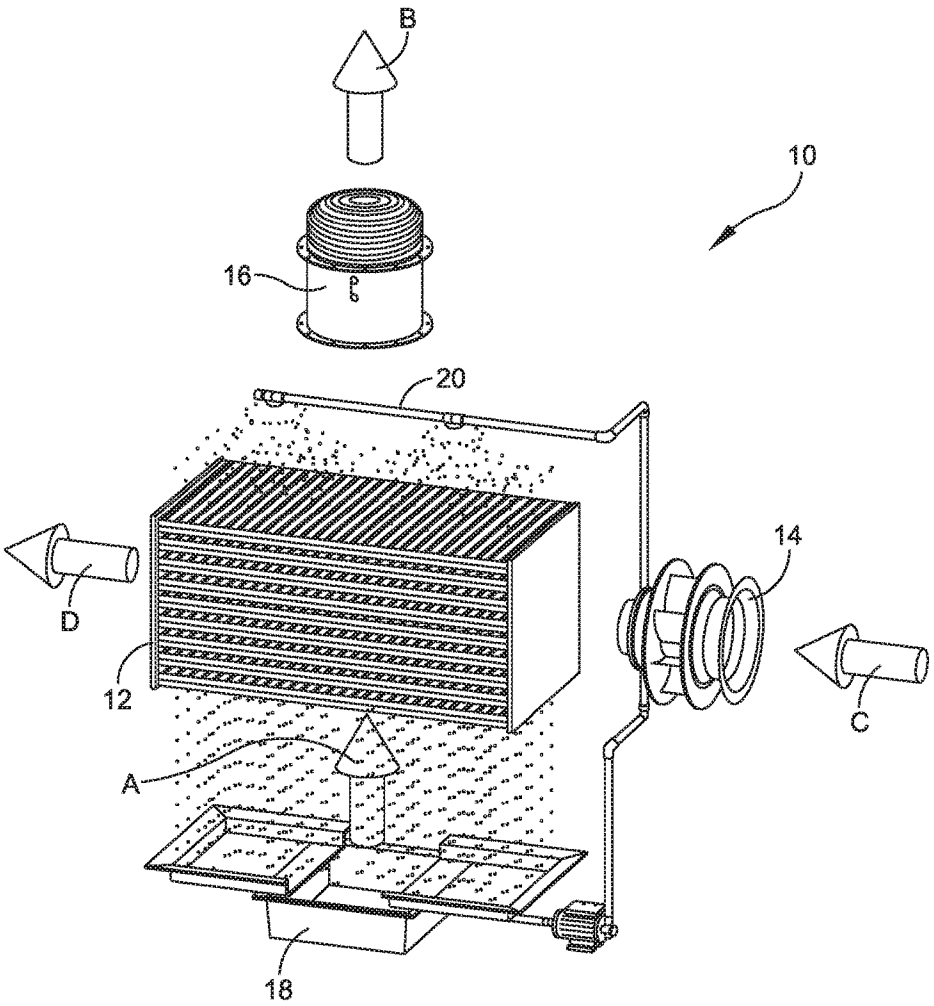
FIG. 1 is an exploded perspective view of an air-to-air heat exchanger within an operational environment.

For the purposes of illustration only, and not to limit the generality, the present disclosure will now be described in detail with reference to the accompanying figures. This disclosure is not limited in its application to the details of construction and the arrangement of components set forth in the following description or illustrated in the drawings. The disclosure is capable of other embodiments and of being practiced or being carried out in various ways. Also the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

Referring to FIG. 1, a typical air-to-air heat exchanger, generally indicated at 10, includes a heat exchanger core 12, a supply fan 14 to move indoor return air (from a building or data center) inside the heat exchanger core and an outdoor exhaust fan 16 to draw outdoor air over the heat exchanger core in a direction perpendicular to the indoor building return air. In one embodiment, the supply fan 14 draws indoor air into the heat exchanger core 12 and the exhaust fan 16 discharges outdoor air to the outside through the heat exchanger core. As air passes through the heat exchanger core 12, heat is transferred from the indoor air to the outdoor air.

The heat exchanger core 12 of the heat exchanger 10 illustrated in FIG. 1 is shown apart from a support frame structure. As shown, relatively cool outdoor intake air is directed to a bottom of the heat exchanger core 12 by an intake air plenum 18 as indicated by arrow A. The outdoor intake air travels through the heat exchanger core 12, and is exhausted by the outdoor exhaust fan 16 disposed above the heat exchanger core as indicated by arrow B. The heat exchanger core 12 is configured to remove heat from the indoor air directed to the heat exchanger core by the supply fan 14 positioned at a near end of the heat exchanger core as indicated by arrow C. The supply fan 14 could also be positioned at the opposite end of the core, near arrow D such that indoor air draws through the core instead of pushing air through the core. After the indoor air travels through the heat exchanger core 12, the cooler indoor air is exhausted at the other end of the heat exchanger core as indicated by arrow D.

In one embodiment, the heat exchanger 10 includes a water spray system 20 positioned above the heat exchanger core 12 to spray water over the heat exchanger core. A water collection system (part of the intake air plenum 18) is positioned below the heat exchanger core 12 of the heat exchanger to collect and recycle the water that is sprayed over the heat exchanger core by the water spray system 20. During operation, water is sprayed on the heat exchanger core 12 of the heat exchanger 10 by the water spray system 20 to provide further cooling to the heat exchanger core. The water that is sprayed on the heat exchanger core 12 of the heat exchanger 10 drips into a trough of the water collection system, which is configured to filter water more efficiently prior to being re-circulated or redistributed back the water spray system 20.

Embodiments of the present disclosure are directed to an air-to-air heat exchanger containing modular heat exchanger core elements. The modularity provides the ability to efficiently produce extremely large heat exchangers and make them field serviceable. The ability to replace just a portion of an extremely large heat exchanger instead of replacing the entire heat exchanger or cooling system provides an advantage over presently available heat exchanger cores.

The present disclosure includes modular heat exchanger elements that are assembled into "bundles" or "core bundles," which are then assembled into a larger cooling unit. In one embodiment, a heat exchanger core includes ten core bundles, which are assembled into a cooling unit, with two columns of five core bundles high each. Each core bundle contains four rows of 48 tubes each totaling 192 tubes in the core bundle, with each tube being approximately ten-foot long. Each core bundle is installed in the cooling unit by placing the core bundle onto one of five shelves, with each shelf holding two core bundles side-by-side. At each end of the core bundle are two seals or gaskets. One seal keeps the indoor air from escaping out of the indoor air space, while the other seal keeps the outside air (OA) and/or water in the outdoor air space. This modularity allows ease of manufacturing while providing a means of replacing or servicing a single core bundle instead of the entire heat exchanger core. In one example, a core bundle from the bottom of the stack can be removed from the unit without first removing a core bundle from above. While some presently available AHUs include large heat exchangers, none offer a modular approach to be able to service a single core bundle in the field without first removing other bundles above.

Figure 2:
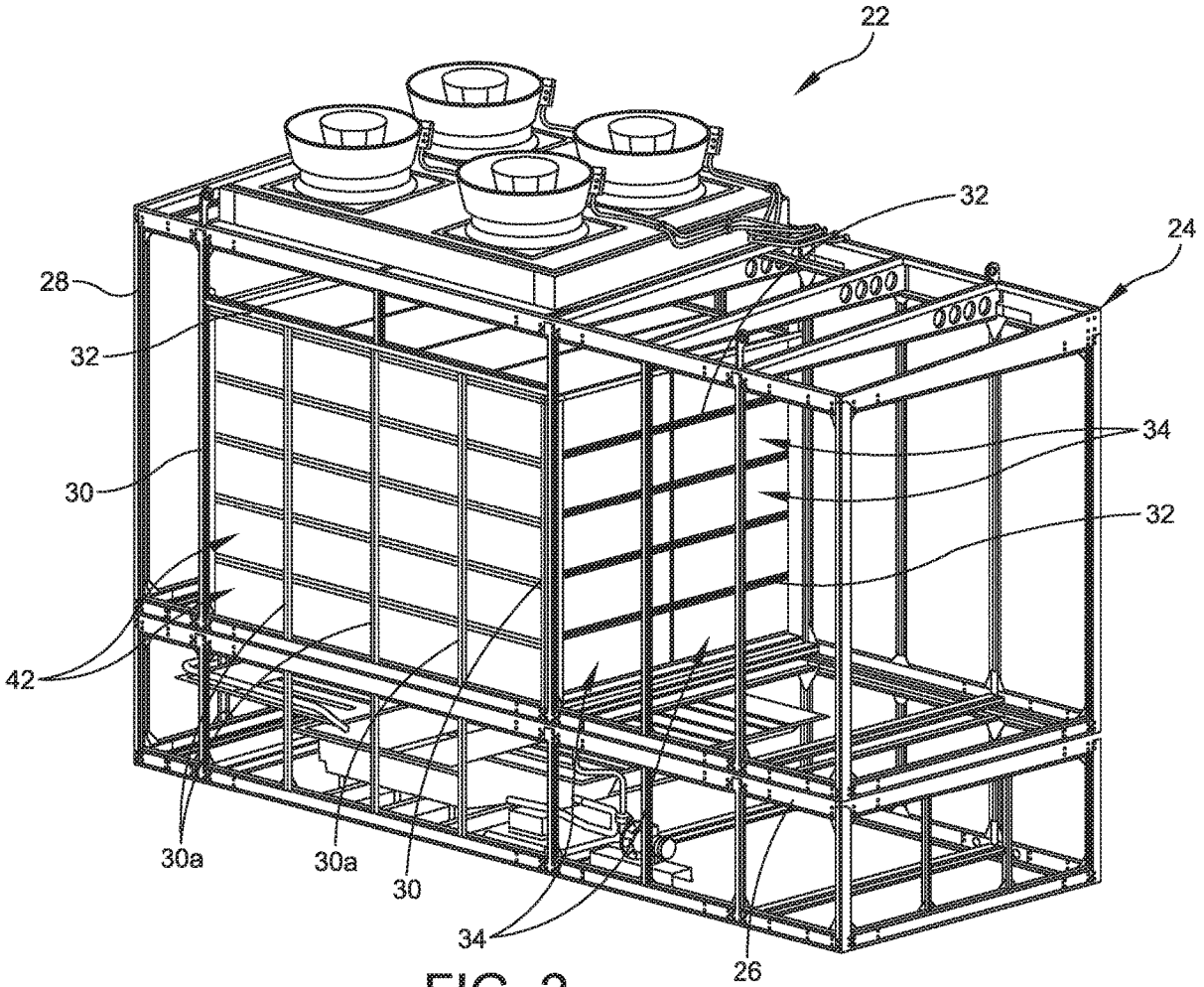
FIG. 2 is a perspective view of a heat exchanger core assembly of an embodiment of the present disclosure.

Referring to FIG. 2, a heat exchanger core assembly is generally indicated at 22. As shown, the heat exchanger core assembly 22 includes a frame assembly, generally indicated at 24, having a base frame section 26, which, in one embodiment, may be secured to a suitable horizontal surface, such as a concrete pad adjacent a building or on a roof of a building. The frame assembly 24 further includes a core support frame section 28 having a plurality of structural vertical posts, each indicated at 30, and horizontal shelf rails, each indicated at 32 that are configured to support a plurality of tubular core bundles, each generally indicated at 34, of the heat exchanger core assembly 22, which provide cooling in the manner described below. The core support frame section 28 further includes a several, e.g., three, intermediate posts, each indicated at 30*a*, which are removable to remove and replace a core bundle 34. In a certain embodiment, the support frame section 28 includes four vertical posts 30 provided at the corners of the support frame section and four horizontal shelf rails 32 that extend between the vertical posts at each end of the support frame section. The number of posts 30, 30*a* and shelf rails 32 can be varied and configured to accommodate any number of core bundles 34 depending on the cooling requirements of the heat exchanger core assembly 22.

In the shown embodiment, the tubular core bundles 34 of the heat exchanger core assembly 22 are positioned on the base frame section 26 and within the support frame section 28 in a manner in which each tubular core bundle extends end-to-end with respect to the orientation of the base frame section. In the example provided in FIG. 2, there are ten core bundles 34. However, as mentioned above, the base frame section 26 and the support frame section 28 can be configured to accommodate any number of core bundles 34 so as to support more than or less than ten core bundles. The manner in which the core bundles 34 are installed and removed from the support frame section 28 will be described with reference to FIGS. 13 and 14.

Figure 3:
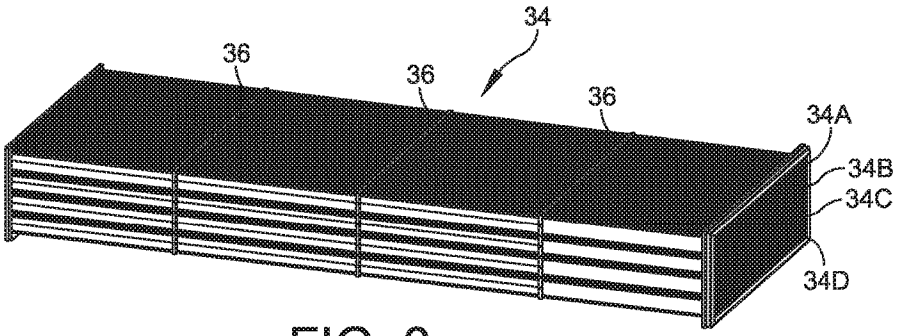
FIG. 3 is a perspective view of a core bundle of the heat exchanger core assembly.

Referring to FIG. 3, a single core bundle 34 is shown apart from the other core bundles. In the shown embodiment, the core bundle 34 includes four rows of tubing (34A, 34B, 34C, 34D), with 48 tubes per row. In this embodiment, the tubes of the core bundle 34 are 9.8 feet long and collectively weigh approximately 360 pounds. It can be appreciated that the scaling of the core bundle enables a single core bundle 34 to be replaced (or repaired) without having to disassemble the entire heat exchanger core assembly 22. For example, a core bundle 34 located at the bottom of a column of core bundles can be removed from the end of the heat exchanger core assembly 22 without affecting the core bundles positioned above the core bundle designated for repair or replacement. As shown, tube supports, each indicated at 36, are provided to secure each row of tubing to one another to provide additional support to the core bundle 34. In the shown embodiment, there are three tube supports 36 used to secure each row of tubing. In one embodiment, each tube support 36 is fabricated from steel, so some other appropriate strong material.

In one embodiment, a seal or gasket is provided at each end of each core bundle 34, one seal or gasket for the indoor air ends of the heat exchanger core assembly 22 and another seal or gasket for the OA and water side of the heat exchanger core assembly. The core bundles 34 of the heat exchanger core assembly 22 include a shelf system that allows for the placement of each core bundle into the support frame section 28 of the frame assembly 24 such that the core bundle can be removed as needed without the removal of the core bundles positioned above the selected core bundle to be replaced or repaired. Specifically, the shelf system allows for the indoor seals to seal against the face of the shelf while locating the core bundles 24 such that the OA seals seal against the OA seal of its neighboring core bundle or the walls of the heat exchanger core assembly 22. The heat exchanger core assembly 22 further includes side walls (see FIGS. 7 and 8) that assemble to the shelves and seal against the core bundles 34 thereby containing the OA and water and keep the OA closer to the tubes on the sides of the heat exchanger core assembly. In certain embodiments, the heat exchanger core assembly 22 further includes center walls to keep the OA closer to the tubes of the core bundle 34 in the center of the heat exchanger core assembly.

Figure 4:
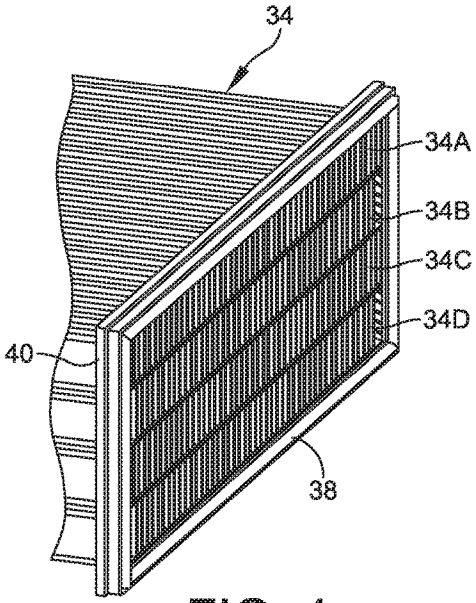
FIG. 4 is an enlarged perspective view of an end of the heat exchanger core bundle.

Referring to FIG. 4, each core bundle 34 is provided with two end gaskets, an indoor face seal gasket 38 that seals the core bundle in the indoor intake air direction and an OA edge seal gasket 40 that seals the core bundle in the OA exhaust direction. In one embodiment, each end of the core bundle is equipped with a gasket bead that the indoor face seal gasket 38 and the OA edge seal gasket 40 are attached. In one embodiment, the ends of the core bundles 34 are equipped with indoor face seal gaskets 38 that seal against a mating face of a shelf of the heat exchanger. The OA edge seal gasket 40, which extends around each end of the core bundle, seals the OA/water side of the core bundles to each other and side walls. As discussed in greater detail below, there is a shelf assembly located at each end of the heat exchanger that facilitates holding each core bundle 34 at correct location vertically such that the OA edge seal gaskets 40 seal against each other, while allowing each row of core bundles to be independently removed.

In one embodiment, the indoor face seal gasket 38 is omega-shaped and includes a flat surface for applying the gasket against an outer edge of the core bundles 34 with a suitable adhesive. In one embodiment, the OA edge seal gasket 40 is shaped similarly to the shape of the indoor face seal gasket 38. In another embodiment, the OA edge seal gasket 40 is semi-circular in shape and includes a prong for securing the gasket to the indoor face of the core bundle 34. The size and shape of the seals can be varied, with the gaskets being co-extruded onto a gasket frame. The corners of the gaskets 38, 40 are spliced at 45° angles to enable continuity of the gasket around the edge of the core bundle 34. In certain embodiments, the gaskets 38, 40 are each fabricated from ethylene propylene diene monomer (EPDM) rubber or some other similar material. The gaskets 38, 40 provide a mechanical seal that fills the space between the mating surfaces.

Figure 5:
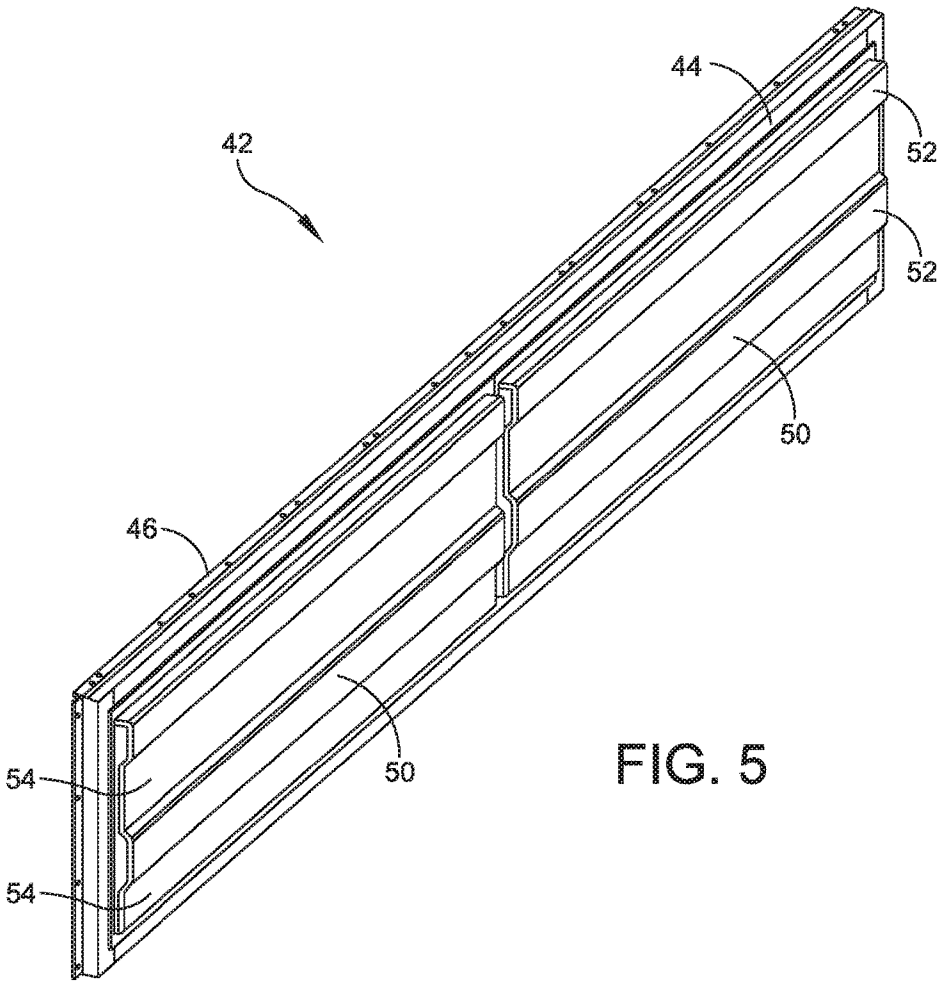
FIG. 5 is a perspective view of a side wall of the heat exchanger core assembly.
Figure 6:
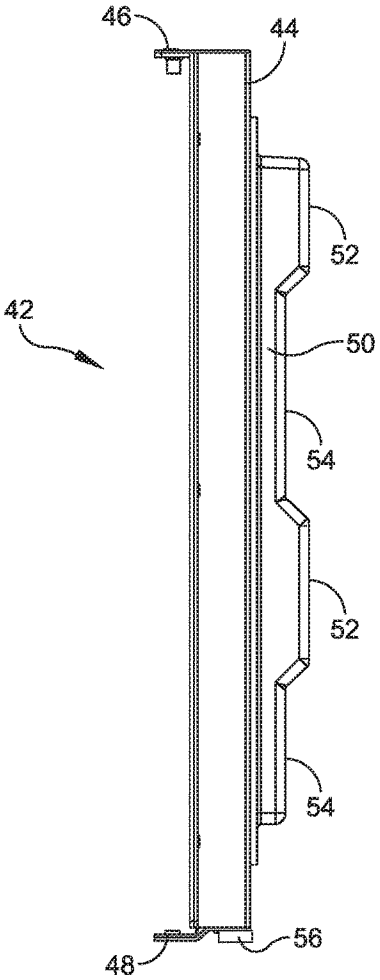
FIG. 6 is a cross-sectional view of the side wall.

FIGS. 5 and 6 illustrate a side wall, generally indicated at 42, of the heat exchanger core assembly 22 that is configured to enclose a side or a portion of the side of the heat exchanger core assembly. In one embodiment, the side wall 42 includes a generally rectangular frame 44, an upper flange 46 provided along a top edge of the rectangular frame, a lower flange 48 provided along a bottom edge of the rectangular frame, and two adjacently positioned inner panels, each indicated at 50, which are supported by the rectangular frame. The upper flange 46 and the lower flange 48 are provided to secure the side wall 42 to the base frame section 26 and the support frame section 28 of the frame assembly 24. The end flanges of the side wall 42 attach to the vertical outside core shelf posts with screws. The horizontal flanges 46, 48 attach to each adjacent flange of the side wall above or below or to the unit frame at the bottom or top, respectively, with screws. In one embodiment, each inner panel 50 of the side wall 42 is fabricated from plastic material by a vacuum forming or thermoforming process. The side wall 42 is configured to be mounted on a side of the support frame section 28 of the frame assembly 24 to enclose a side of the heat exchanger core assembly 22.

As shown, the inner panels 50 of the side wall are configured to offset sides of the rows of the core bundle 34. Specifically, each inner panel includes a horizontally disposed raised panel section 52 and a horizontally disposed recessed panel section 54. The purpose of offsetting the sides of the rows of the core bundle is to cause the air to spend more time on the tube surfaces of the core bundle to enhance the amount of heat exchange. By having the side wall and center wall panels offset match the row offsets, the OA remains close to the heat exchanger tubes. As shown, a gasket 56 is provided around a bottom edge of the frame 44 to provide a seal with the base frame section 26 of the frame assembly 24 for the bottom side wall and to seal against the flange 46 of each side wall below. The arrangement is such that the side wall 42, when combined with all other side walls, creates a sealed barrier at the front and rear of the core assembly.

Figure 7:
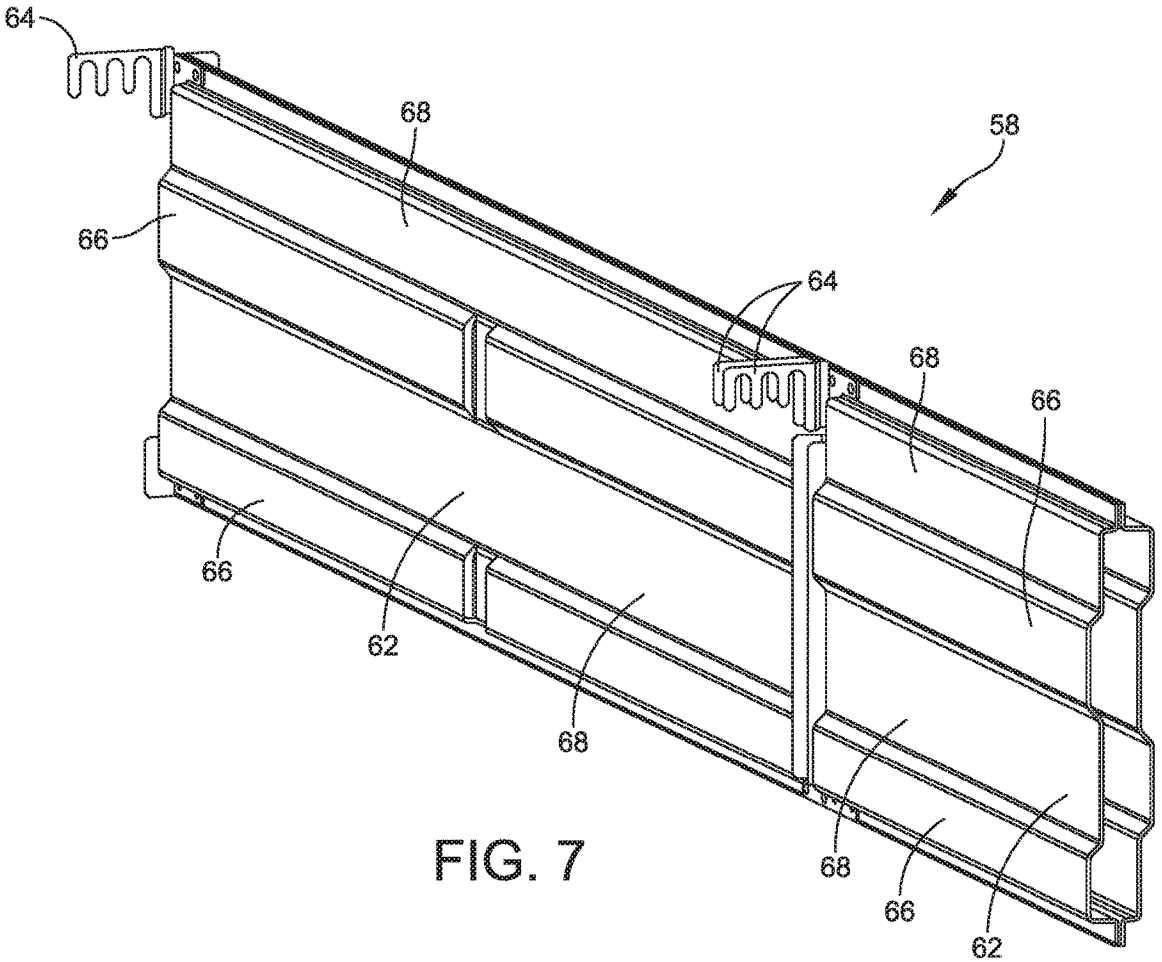
FIG. 7 is a perspective view of a center wall of the heat exchanger core assembly.

FIG. 7 illustrates a center wall, generally indicated at 58, of the heat exchanger core assembly 22 that is configured to be positioned lengthwise between two adjacently placed core bundles 34. In one embodiment, the center wall 58 includes two adjacently positioned inner panels, each indicated at 62, which are attached to each other in such a manner that they form a hollow wall sub-assembly. Several brackets, each indicated at 64, provided in the center and corners of the center wall attach and support two of these hollow wall assemblies and thereby form the complete center wall assembly. The center wall 58 is positioned between to adjacently placed core bundles 34 with the hanging brackets 64 being configured to hang on a core of a core bundle 34 to locate the center wall. As each inner panel 50 of the side wall 42, each inner panel 62 of the center wall 58 is fabricated from plastic material by a vacuum forming or thermoforming process. The center wall 58 is configured to be positioned between two adjacently placed core bundles 34 to separate them. As shown, the inner panels 62 of the center wall are configured to offset sides of the rows of the core bundle 34. Specifically, each inner panel 62 includes a horizontally disposed raised panel section 66 and a horizontally disposed recessed panel section 68.

Figure 8:
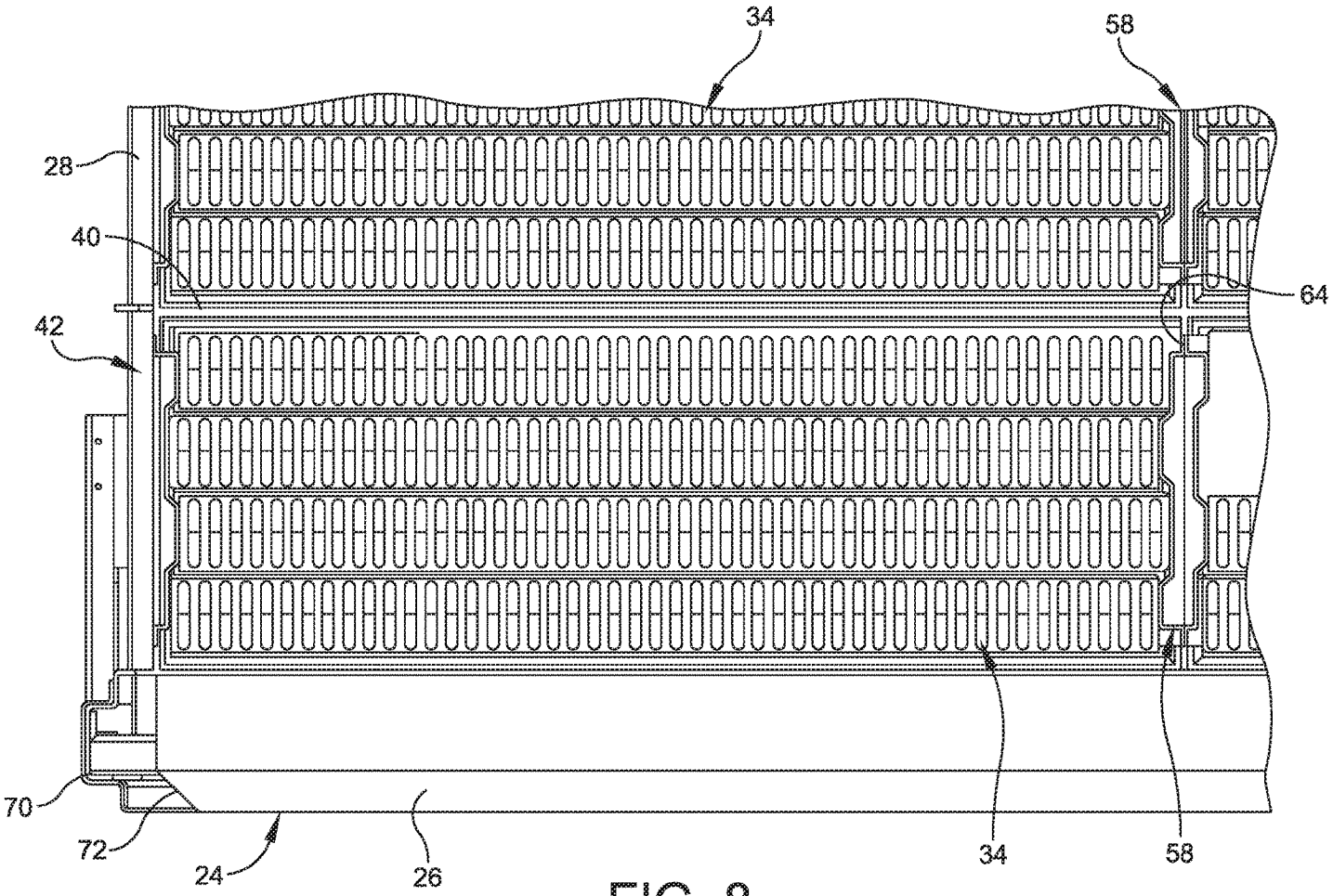
FIG. 8 is a cross-sectional view of the heat exchanger core assembly.

Referring to FIG. 8, the components of the heat exchanger core assembly 22 are shown in cross section. As shown, the core bundles 34 are arranged on the base frame section 26 within the support frame section 28 of the frame assembly 24, with the edge seal gaskets 40 providing horizontal bundle-to-bundle edge seals. The base frame section 26 of the frame assembly 24 includes a unit base 70 having a deflector 72 around a perimeter of the core bundles 34, with an edge seal gasket 40 associated with the bottom core bundle to provide a sealed configuration. As shown, the side walls 42 enclose the core bundles along a side of the support frame (core shelf) section 28 of the frame assembly 24 of the heat exchanger core assembly 22. The center walls 58 are provided as well, and are supported by the hanging brackets 64 on the core tubing of the top row of the core bundle 34.

Figure 9:
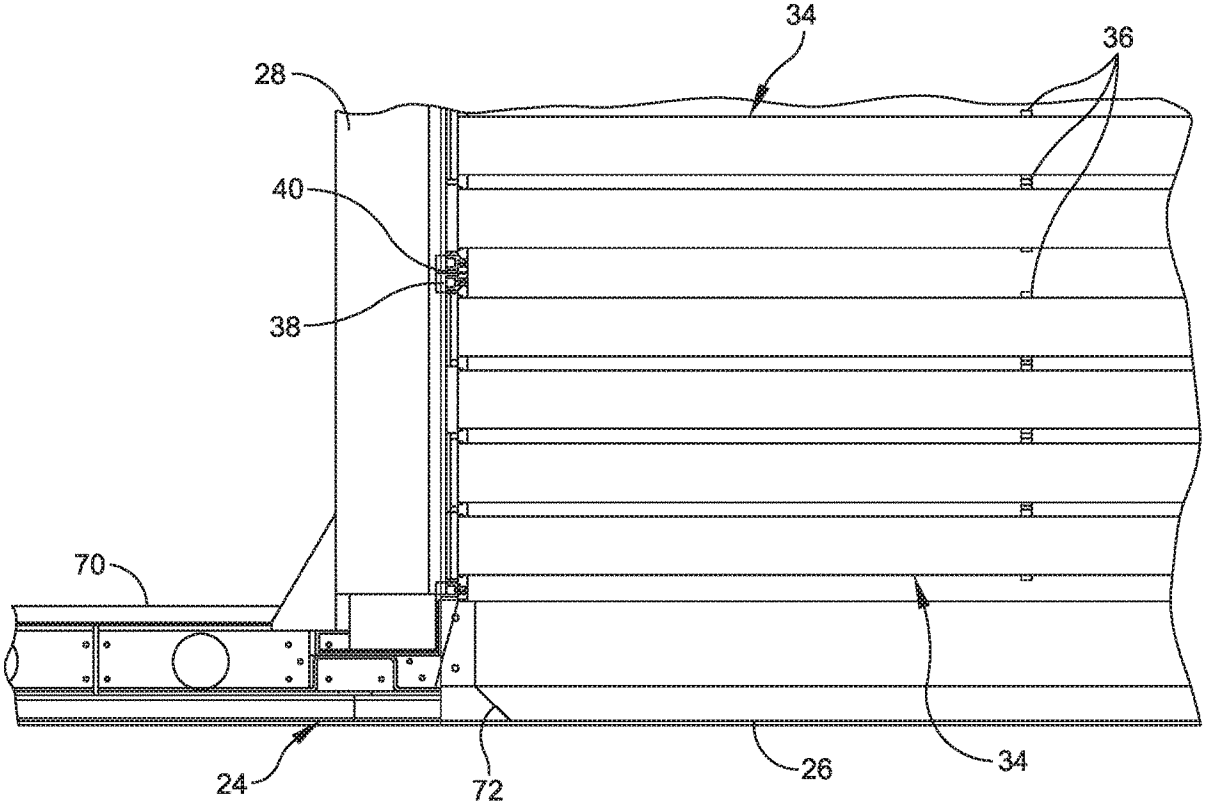
FIG. 9 is another cross-sectional view of the heat exchanger core assembly.

Referring to FIG. 9, the bottom core bundle 34 includes the edge seal gasket 40, which mates with an edge seal gasket of the core bundle positioned above the bottom core bundle. The core bundles 34 each further include the indoor face seal gasket 38, which provides a seal at the ends of the core bundles to each core shelf. The unit base 70 and the deflector 72 of the base frame section 26 of the frame assembly 24 are shown, with the edge seal gasket 40 of the bottom core bundle 34 sealing the assembly with respect to the base frame section. In this view, the steel tube supports 36 are shown, which separate rows of the core bundle 34 from one another.

Figure 10:
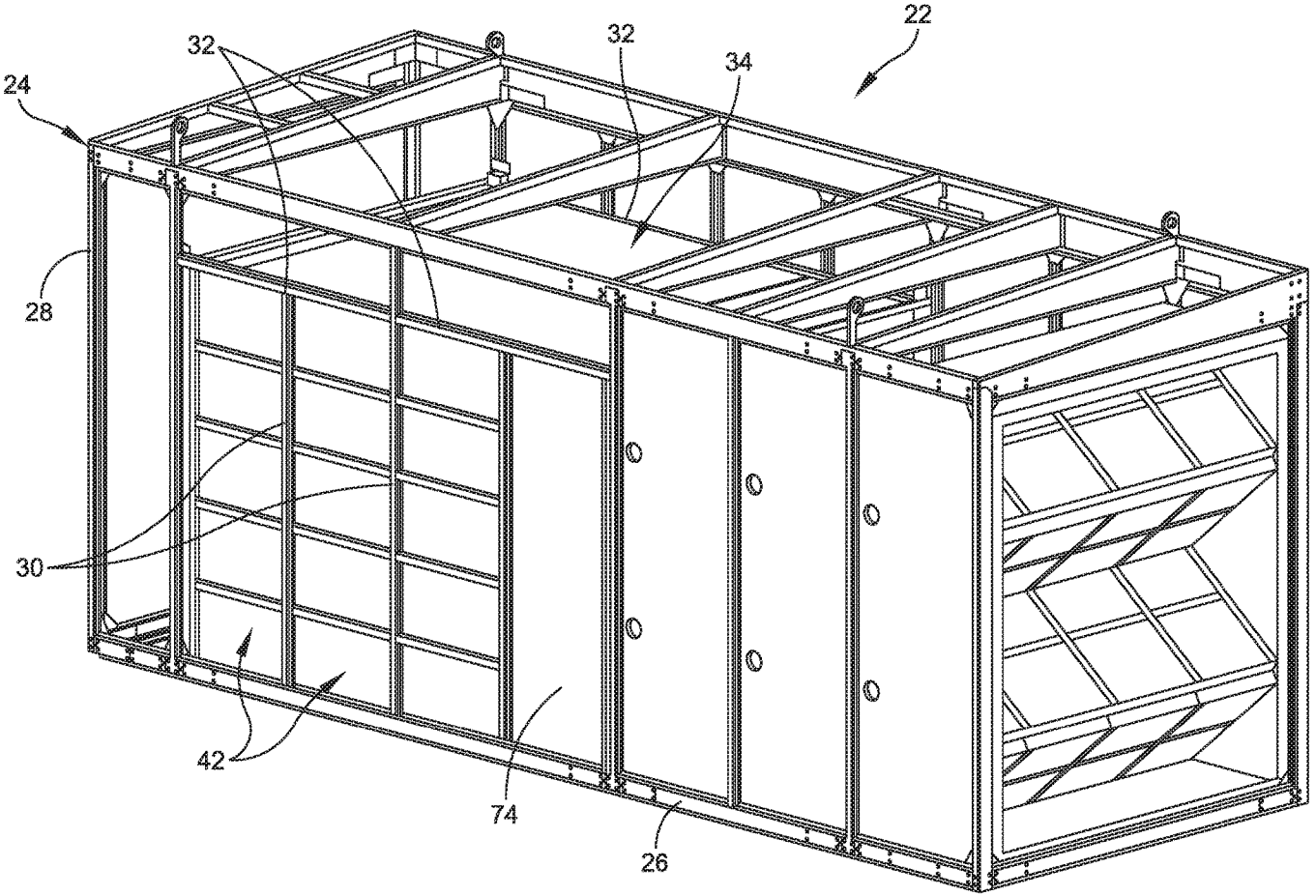
FIG. 10 is perspective view of a cooling unit including a heat exchanger core assembly of embodiments of the present disclosure.

Referring to FIG. 10, the side walls 42 would be removed in the event of a core bundle 34 change. In such an instance, the posts would be removed in the event of a core bundle 34 change. Also, a core section outer panel 74 would be removed in the event of a core bundle 34 change. In this instance, a core bundle 34 located at the bottom of a column of core bundles can be removed from the front of the heat exchanger core assembly 22 without affecting the core bundles positioned above (or below) the core bundle designated for repair or replacement. The tube supports 36 ensure that each row of tubing is properly secured to one another to provide additional support to the core bundle 34.

Figure 11:
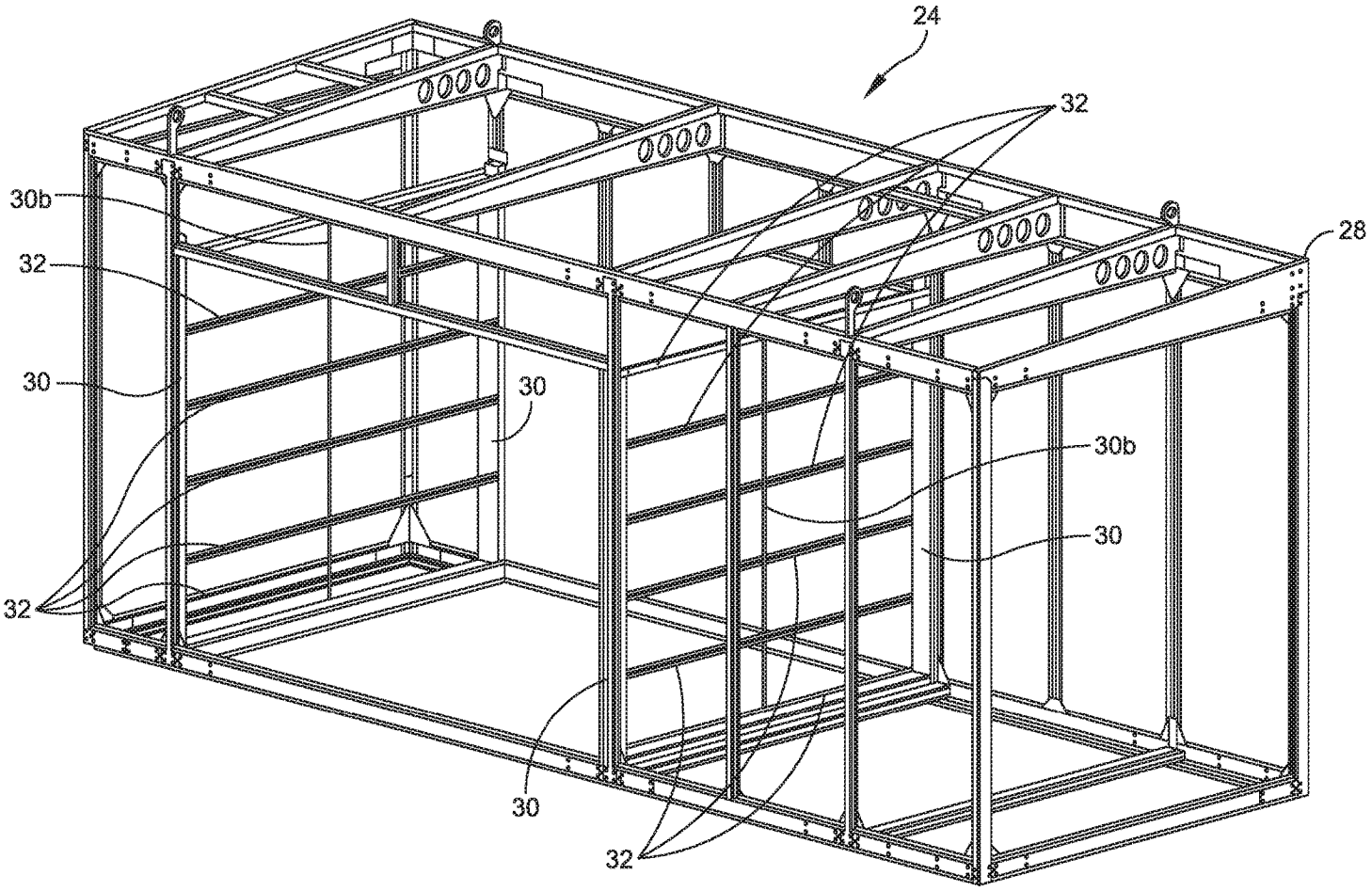
FIG. 11 is a perspective view of a frame assembly of the heat exchanger core assembly.

FIG. 11 illustrates the support frame section 28 of the frame assembly 24 apart from the other components of the heat exchanger core assembly 22. As shown, each horizontal shelf rail 32 is constructed in a similar manner and provided at the ends of the space in which the core bundles 34 are disposed. As shown, there are four vertical posts 30 at the corners of the space in which the core bundles 34 are disposed and two additional vertical posts, each indicated at **30*b*, with one post provided at each end of the where the core bundles are positioned. As shown, the three removable vertical posts 30*a* are removed to slide the core bundles 34** in place.

Figure 12:
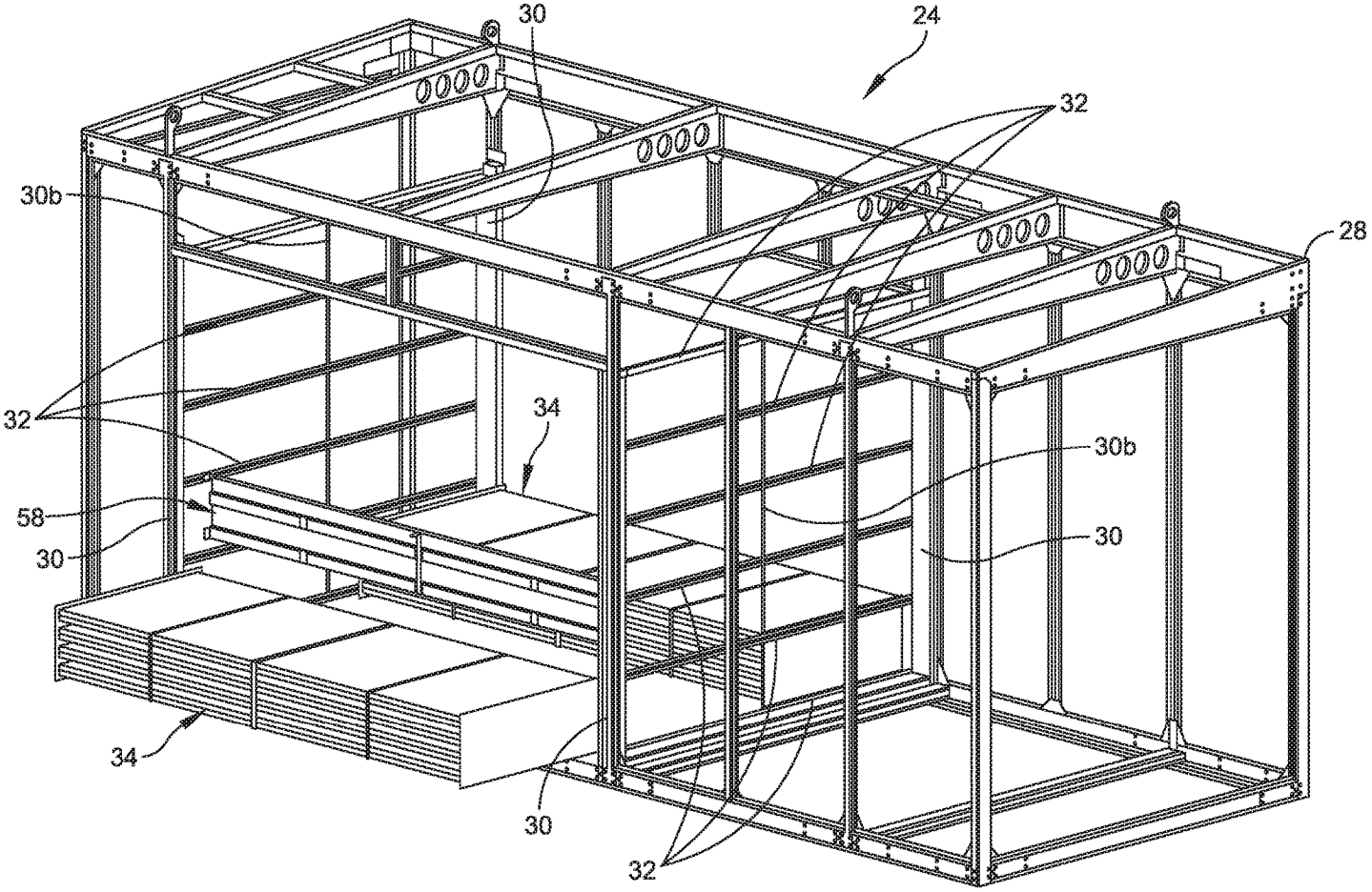
FIG. 12 is a perspective view of two core bundles and a center wall being installed in the frame assembly of the heat exchanger core assembly.

FIG. 12 illustrates two core bundles 34 and a center wall 58 being positioned within the frame assembly 24. As shown, a first core bundle 34 is positioned within the space defined by the four vertical posts 30 into the back or rear of the space in a position in which the core bundle rides along a shelf defined by the support frame section 28 of the frame assembly. The center wall 58 is positioned next to the first core bundle 34 between the two core bundles 34 that form the bottom row of the heat exchanger core assembly 22, and as described above, are hung on coils of the core bundles by the hanging brackets 64. A second core bundle 34 is positioned in front of the first core bundle, and is slid on the shelf into its final position.

Figure 13:
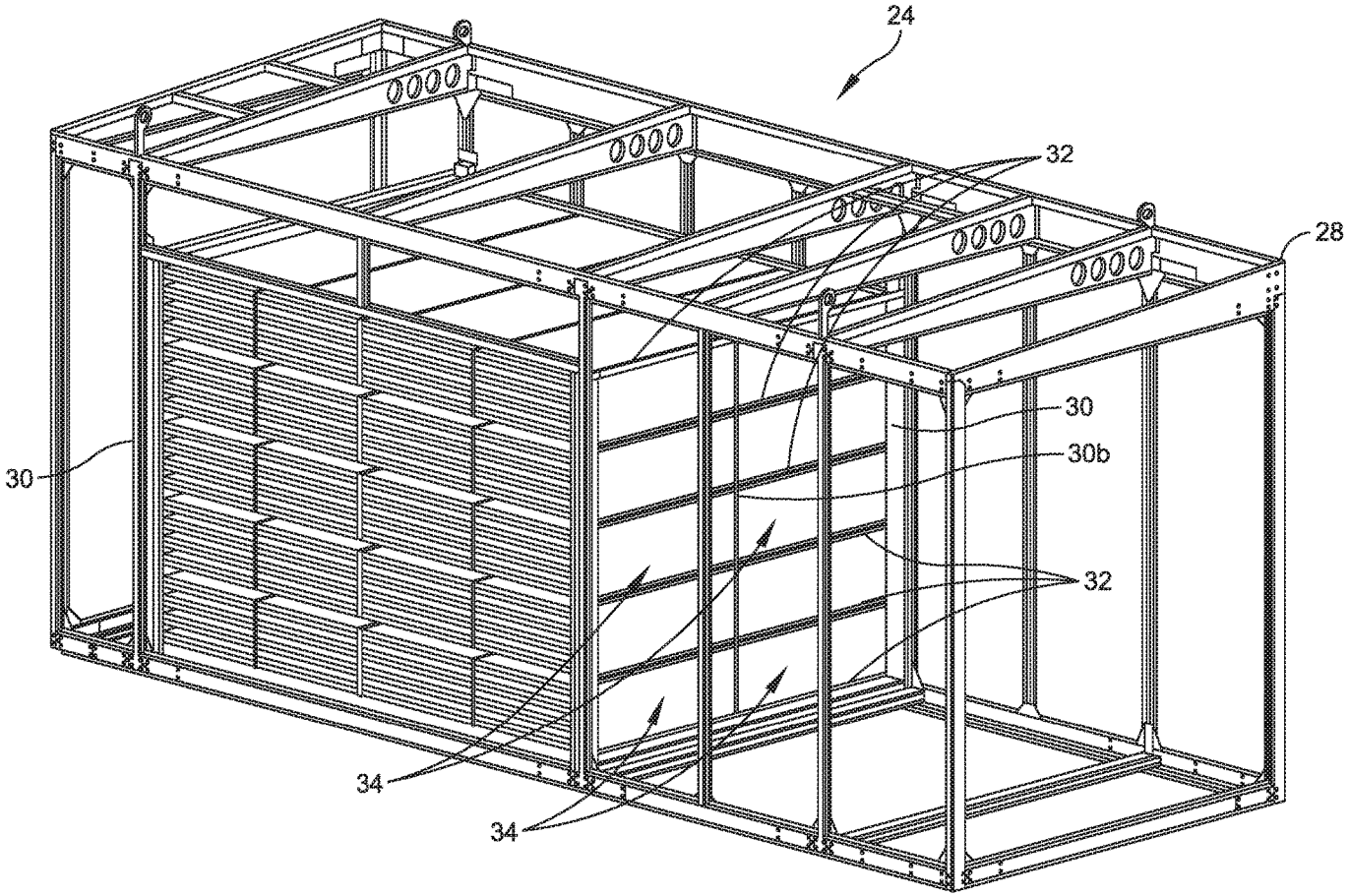
FIG. 13 is a perspective view of ten core bundles and center walls being installed in the frame assembly.

FIG. 13 illustrates all ten core bundles 34 positioned within the frame assembly 24. As shown, in one embodiment, the heat exchanger core assembly 22 includes two columns of five core bundles 34, with each row of two core bundles being positioned on a shelf at each end of the core bundle.

Figure 14:
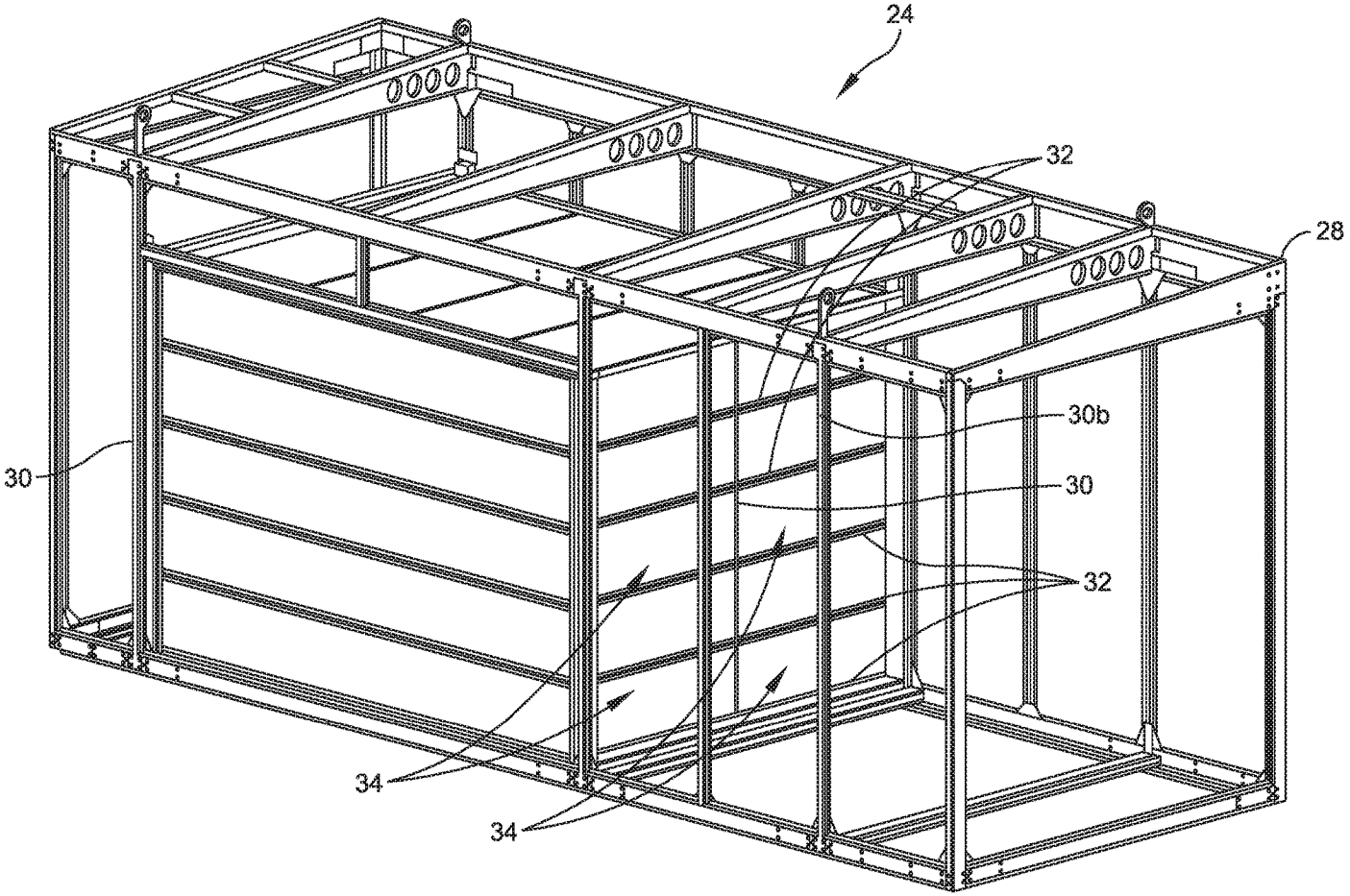
FIG. 14 is a perspective view of the heat exchanger core assembly shown in FIG. 13 with side walls installed to enclose sides of the frame assembly.

FIG. 14 illustrates the assembled heat exchanger core assembly 22. As shown, the side walls 42 are attached to the support frame section 28 of the frame assembly 24 to enclose a side of the frame assembly.

In one embodiment, a method of replacing a core bundle of the heat exchanger core assembly includes identifying a core bundle requiring replacement, exposing a side of the core assembly by removing the outer panels 74, if provided, removing the intermediate posts **30*a*, removing the side walls 42** of the same bundle row as the bundle needing replacement, and then removing the core bundle by accessing sliding the core bundle with respect to the remaining plurality of core bundles, and inserting a replacement core bundle in a space defined by the removed core bundle. The method further includes sealing an end of the replacement core bundle from an adjacently placed core bundle with an edge seal gasket and sealing the end of the replacement core bundle with respect to the frame assembly by an indoor face seal gasket.

It should be observed that the heat exchanger core assembly includes core bundles that can be configured in a modular fashion, containing a variable number of tubes in a varying number of "bricks." The "brick modules" can be produced in differing number of tubes per brick. This allows for a maximum amount of design flexibility to size the heat exchanger in the "width" dimension. The brick modules can also be produced in varying length, which allows for a maximum amount of design flexibility to size the heat exchanger in the "length" dimension. The quantity of brick module rows per core bundle can be varied to allow for maximum flexibility in the "height" dimension of the heat exchanger.

Having thus described at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting. The disclosure's limit is defined only in the following claims and equivalents thereto.

What is claimed is:

1. A heat exchanger core assembly comprising:

a frame assembly;

a plurality of core bundles positioned within the frame assembly, each core bundle including at least one row of tubing defining at least one end of the core bundle, an edge seal gasket to seal the core bundle from an adjacently placed core bundle, and an indoor face seal gasket to seal the at least one end with respect to the frame assembly, wherein the at least one row of tubing define a first end and a second end, each of the first end and the second end having the edge seal gasket and the indoor face seal gasket, and wherein the rows of the core bundles are offset from one another; and a center wall configured to be positioned lengthwise between two adjacently placed core bundles;

wherein the center wall includes at least one inner panel and at least one hanging bracket provided along a length of the at least one inner panel, the at least one hanging bracket being configured to hang on a core of a core bundle to support the center wall.

2. The heat exchanger core assembly of claim 1, wherein the frame assembly includes a base frame section, the support frame section extending from the base frame section.

3. The heat exchanger core assembly of claim 2, wherein the plurality of core bundles are positioned within the support frame section in a manner in which each core bundle extends end-to-end with respect to an orientation of the base frame section.

4. The heat exchanger core assembly of claim 1, wherein each row of tubing is secured by a tube support.

5. The heat exchanger core assembly of claim 1, wherein a face seal gasket of a core bundle of the plurality of core bundles seals the core bundle in a manner that prevents the leakage of indoor air into an outdoor air space, and a outdoor edge seal gasket of a core bundle of the plurality of core bundles seals the core bundle in a manner that prevents intrusion of outdoor air into an indoor air space.

6. The heat exchanger core assembly of claim 1, further comprising a side wall configured to enclose a side or a portion of a side of the heat exchanger core assembly.

7. The heat exchanger core assembly of claim 6, wherein the side wall includes a rectangular frame, an upper flange provided along a top edge of the rectangular frame, a lower flange provided along a bottom edge of the rectangular frame, and at least one inner panel supported by the frame.

8. The heat exchanger core assembly of claim 7, wherein the at least one inner panel includes a horizontally disposed raised panel section and a horizontally disposed recessed panel section to offset sides of adjacent core bundles.

9. The heat exchanger core assembly of claim 1, wherein an inner panel of the at least one inner panel includes a horizontally disposed raised panel section and a horizontally disposed recessed panel section to offset sides of adjacent core bundles.

* * * * *